US007287665B2

(12) United States Patent
Meissen et al.

(10) Patent No.: US 7,287,665 B2
(45) **Date of Patent: *Oct. 30, 2007**

(54) WASTE CONTAINER

(75) Inventors: Cynthia R. Meissen, Atlanta, GA (US); William P. Apps, Alpharetta, GA (US); Roger S. Hsu, Torrance, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/542,505

(22) Filed: Oct. 3, 2006

(65) Prior Publication Data

US 2007/0029338 A1 Feb. 8, 2007

Related U.S. Application Data

(63) Continuation of application No. 10/435,164, filed on May 9, 2003, now Pat. No. 7,114,631.

(51) Int. Cl.
*B65D 25/10* (2006.01)

(52) U.S. Cl. ..... 220/766; 220/908

(58) Field of Classification Search ..... 220/752, 220/755, 757, 762, 763, 764, 766, 810, 832, 220/836, 846, 908; 280/47.17, 47.24, 47.26, 280/47.315, 47.36, 47.34, 47.371, 655, 655.1
See application file for complete search history.

(56) References Cited

U.S. PATENT DOCUMENTS

| | | | |
|---|---|---|---|
| 3,384,385 | A | 5/1968 | Cohen et al. |
| 3,830,514 | A | 8/1974 | Green |
| RE30,890 | E | 3/1982 | Hodge |
| 4,499,998 | A | 2/1985 | Carlson |
| 4,600,113 | A | 7/1986 | Demars |
| 4,691,840 | A | 9/1987 | Ferbrache |
| 4,873,841 | A | 10/1989 | Bradshaw et al. |
| 5,163,577 | A | 11/1992 | Lee |

(Continued)

FOREIGN PATENT DOCUMENTS

| | | |
|---|---|---|
| CA | 2 344 843 | 11/2001 |

(Continued)

OTHER PUBLICATIONS

Brochure—"Milko Der Milko 42-Liter-Rollerbehalter Minimale Abmessungen Maximaler Vorteil," 1996.

*Primary Examiner*—Anthony D. Stashick
*Assistant Examiner*—Harry A Grosso

(57) ABSTRACT

A waste container includes a handle rotatably mounted on the side wall. The handle includes a first grip at an outer end of a short arm and a second grip at the outer end of a long arm. The handle is rotatable relative to the waste container, between a first position where the first grip extends a first distance above an upper edge of the side wall of the waste container and a second position where the second grip extends a second distance above the upper edge of the side wall, with the second distance being substantially greater than the first distance. In this manner, the handle can be moved to the proper location for either pulling the waste container on its wheels or for emptying the waste container into the hopper of a truck.

28 Claims, 10 Drawing Sheets

U.S. PATENT DOCUMENTS

| | | | |
|---|---|---|---|
| D347,095 | S | 5/1994 | Apps |
| D388,577 | S | 12/1997 | Rehrig |
| D398,120 | S | 9/1998 | Rehrig |
| D410,125 | S | 5/1999 | Rehrig et al. |
| 5,899,468 | A | 5/1999 | Apps |
| 6,276,557 | B1 | 8/2001 | Wysocki |
| 6,311,991 | B1 | 11/2001 | Conrado et al. |
| D476,125 | S | 6/2003 | Chen |
| 2002/0158068 | A1 | 10/2002 | Panek |

FOREIGN PATENT DOCUMENTS

| | | |
|---|---|---|
| DE | 830 171 | 1/1952 |
| DE | 11 91 740 | 4/1965 |
| DE | 201 02 335 | 7/2001 |
| DK | 9 400 100 | 6/1995 |
| DK | 9 600 446 | 5/1997 |
| EP | 1 106 535 | 6/2001 |
| EP | 1 157 946 | 11/2001 |
| GB | 2 248 381 | 4/1992 |
| NL | 1 000 761 | 6/1997 |
| WO | WO 97 46468 | 12/1997 |
| WO | WO 03/050017 | 6/2003 |

WASTE CONTAINER

This application is a continuation of U.S. patent application Ser. No. 10/435,164, which was filed on May 9, 2003 now U.S. Pat. No. 7,114,631.

BACKGROUND OF THE INVENTION

The present invention relates generally to containers and, more particularly, to a waste container.

Waste containers typically include a bottom wall and a side wall extending from the periphery of the bottom wall to define the container. Often, the waste container includes wheels below the side wall to facilitate the transport of a loaded waste container. Many waste containers also include handles. Some waste containers include diametrically opposed short handles, which extend slightly outwardly or slightly upwardly of the top of the side wall. While these handles are useful for lifting the waste container, such as for emptying the waste container into the hopper of a truck, these handles are not well-suited for pulling the waste container on the wheels. Longer handles are more suited to pulling the waste container on the wheels, but inconvenient for lifting the waste container.

SUMMARY OF THE INVENTION

The present invention provides a waste container having a handle which is movable between a first position close to an upper edge of the side wall, where it is more useful for emptying the waste container into the hopper of a truck, and second position at a greater distance above the upper edge of the side wall, where it is more useful for pulling the waste container on the wheels. In one embodiment of the waste container according to the present invention, the handle includes two arms pivotable about a single pivot point on the side wall. The arms extend different lengths from the pivot point to a grip. When the shorter arm is rotated to a use position above the upper edge of the side wall, the grip on the shorter arm is convenient for emptying the waste container into a hopper of a truck. When the longer arm is rotated to the use position above the upper edge of the side wall, the grip of the longer arm is convenient for pulling the waste container on the wheels.

BRIEF DESCRIPTION OF THE DRAWINGS

Other advantages of the present invention can be understood by reference to the following detailed description when considered in connection with the accompanying scale drawings wherein.

DETAILED DESCRIPTION OF THE PREFERRED EMBODIMENT

Figure 1:
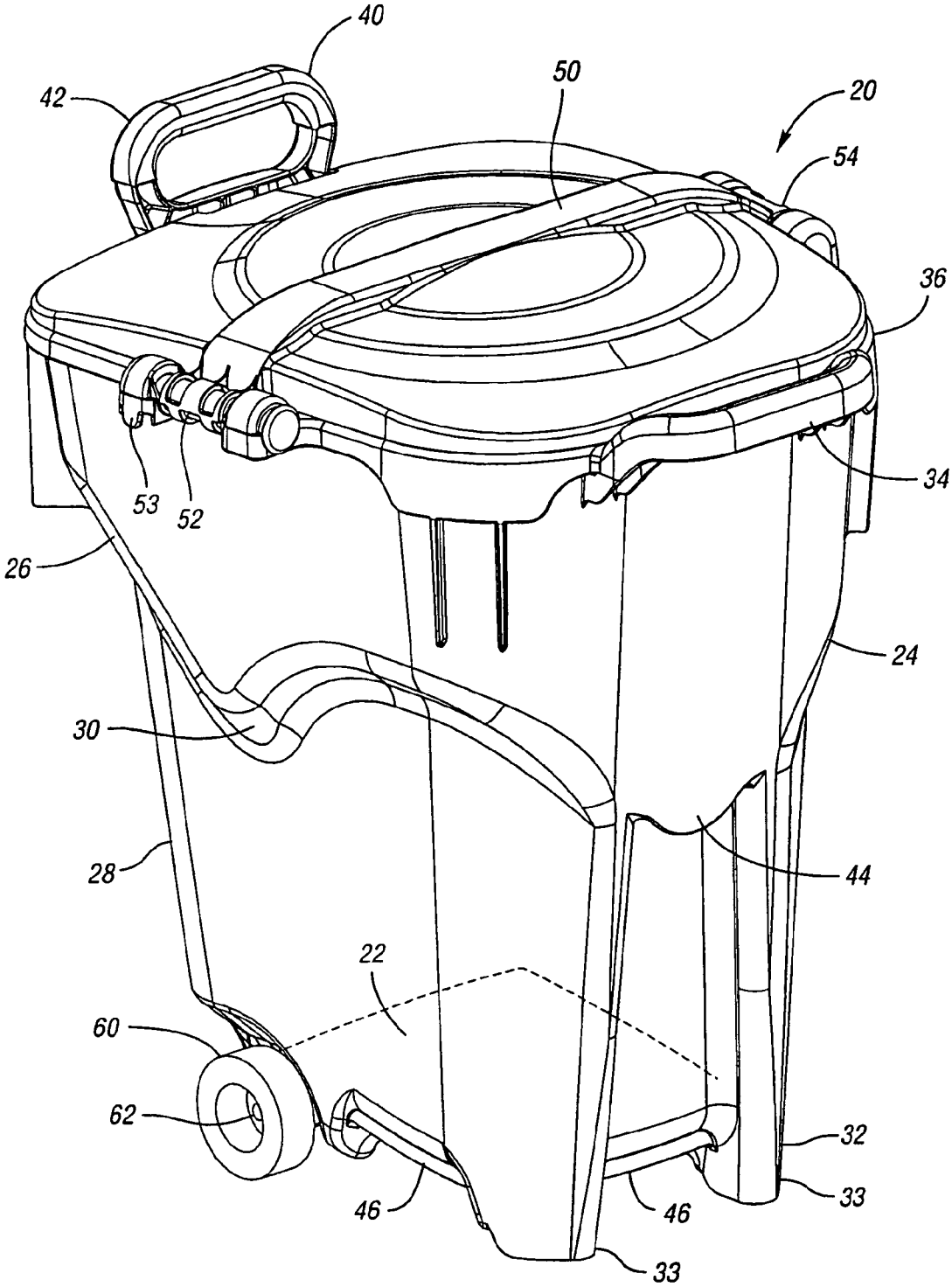
FIG. 1 is a front perspective view of a waste container according to the present invention.

A waste container 20 according to the present invention is shown in FIG. 1. The waste container 20 includes a bottom wall 22 integrally molded with a side wall 24 that extends upwardly from the periphery of the bottom wall 22. The side wall 24 includes an upper portion 26 and a lower portion 28. The upper portion 26 has a larger diameter than the lower portion 28. A tapered mid-portion 30 of the side wall 24 connects the upper portion 26 to the lower portion 28. The tapered mid-portion 30 is contoured vertically along the side wall 24 to present an esthetically pleasing design. A base 32 extends downwardly from the bottom wall 22 beneath the side wall 24. Two feet 33 of the base 32 support the waste container 24.

The waste container 20 includes a fixed handle 34 integrally molded with the side wall 24 and extending generally upwardly and outwardly from an upper edge 36 of the side wall 24. The waste container 20 further includes an adjustable handle 40 opposite the fixed handle 34. The adjustable handle 40 includes a first grip 42, which in FIG. 1 is extending above the upper edge 36 of the side wall 24. An integrally-molded lip extends downwardly parallel to the side wall 24 to form a front handle 44. Similar integrally-molded lips extend downwardly from front and side peripheral edges of the base 32 to form additional handles 46 that are useful for inverting the waste container 20 to dump the contents.

A lid 50 is hingeably connected to the upper edge 36 of the side wall 24 via a hinge 52. The hinge 52 includes a catch tab 53 protruding downwardly. When the lid 50 is opened completely, such that it hangs down adjacent the side wall 24, the lid 50 will snap behind the catch tab 53, thereby preventing the lid 50 from closing or getting in the way while the waste container 20 is inverted for dumping the contents.

Figure 2:
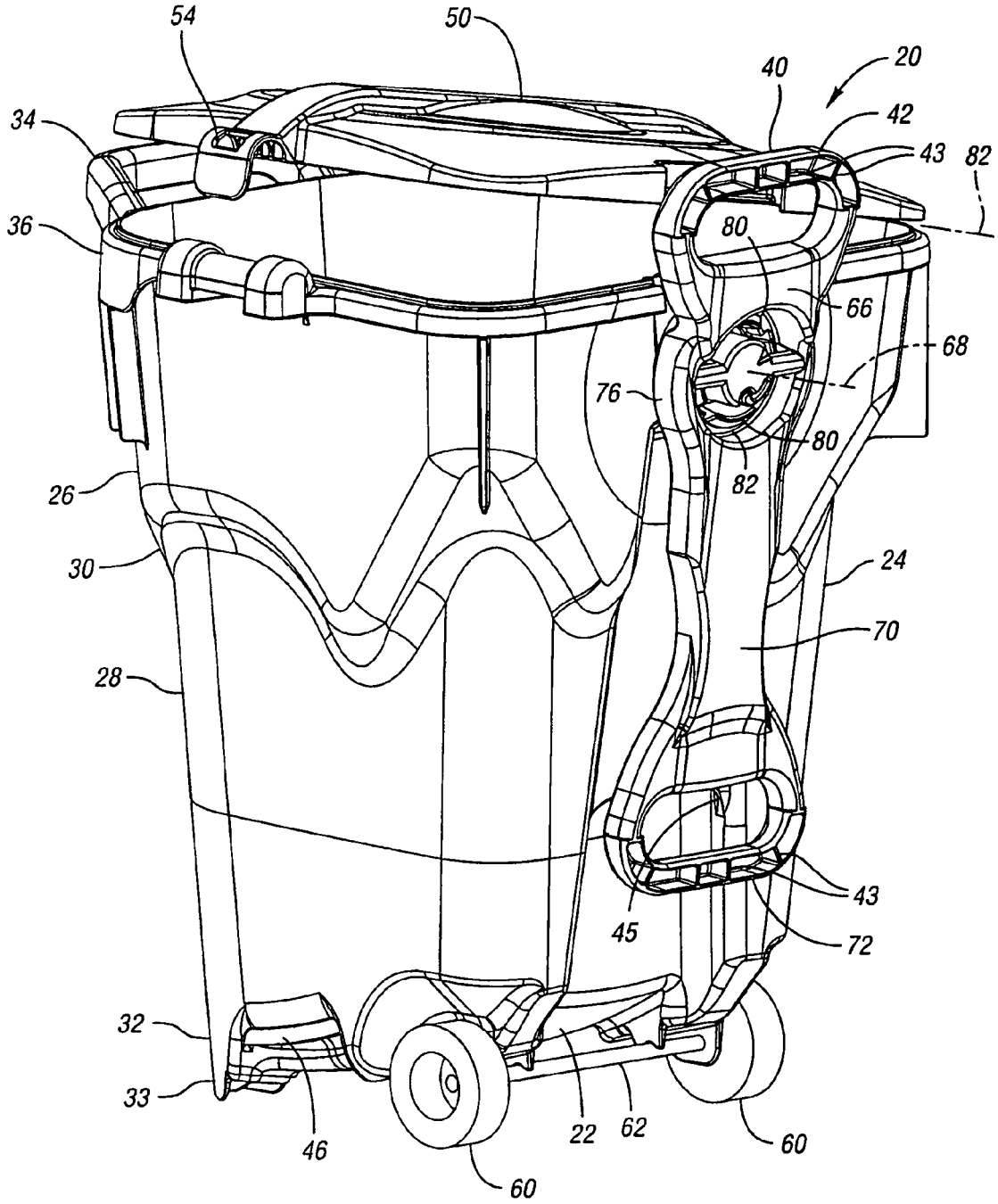
FIG. 2 is a rear perspective view of the waste container of FIG. 1, with the lid slightly open.

A latch 54 opposite the hinge 52 removably secures the lid 50 to the upper edge 36 of the side wall 24 in an interference fit or latch mechanism. The hinge 52 and latch 54 protrude laterally from the upper edge 36 of the side wall 24 and therefore can also be used as handles for lifting and dumping the waste container 20. The waste container 20 further includes a pair of wheels 60 mounted on an axle 62 for rotation relative to the waste container 20, as can be seen in FIGS. 1 and 2. The waste container 20 contacts the ground at four contact areas: the two wheels 60 and the two feet 33 of the base 32.

As can be seen in FIG. 2, the handle 40 further includes a short arm 66 extending from a pivot axis 68 to the first grip 42. The handle 40 further includes a long arm 70 extending from the pivot axis 68 to a second grip 72. The short and long arms 66, 70 extend in opposite directions from the pivot axis 68. The handle 40 further includes a base portion 76 between the short arm 66 and long arm 70. The base 76 of the handle 40 is rotatably supported on the side wall 24 by locking tabs 80 that are slidably secured to an inner, annular flange 82 in the base portion 76. Of course, handle 40 may be attached to side wall 24 in any manner designed to achieve the teachings according to the present invention. In this manner the entire handle 40 is rotatable about the axis 68 relative to the side wall 24. In order to maintain the equidistant spacing between the handle 40 and the side wall 24, the pivot axis 68 is normal to the side wall 24. As a result, the handle 40 is spaced equally from the side wall 24 in any rotated position.

For ergonomic reasons, the first and second grips 42, 72 have a reversed geometry, i.e. the ribs 43 in the grips 42, 72 extend the opposite direction compared to the ribs in the remainder of the handle 40. The side wall 24 includes an integrally-molded lip extending downward parallel to a rear surface of the side wall 24 to form a rear handle 45. As can be seen in FIG. 2, the rear handle 45 is accessible through the second grip 72 when the long arm 70 is in the downward position.

FIG. 2 illustrates the lid 50 of waste container 20 in a slightly open position. The lid 50 is hingeably connected by hinge 54 (FIG. 1) to the upper edge 36 of the side wall 24. The lid 50 is thus pivotable about an axis 82 substantially at the upper edge 36 of the side wall 24. As will be noted, the axis about which the lid 50 pivots is generally parallel to the axis 68 about which the handle 40 rotates. As will be further noted, the axes 68, 82 are not parallel to the axle 62, and in fact, the axes 68, 82 are normal to planes that are perpendicular to planes normal to the axle 62. Because the axle 62 is exposed, the axle 62 can also be grasped as a handle for lifting and dumping the contents of the waste container 20.

Figure 3:
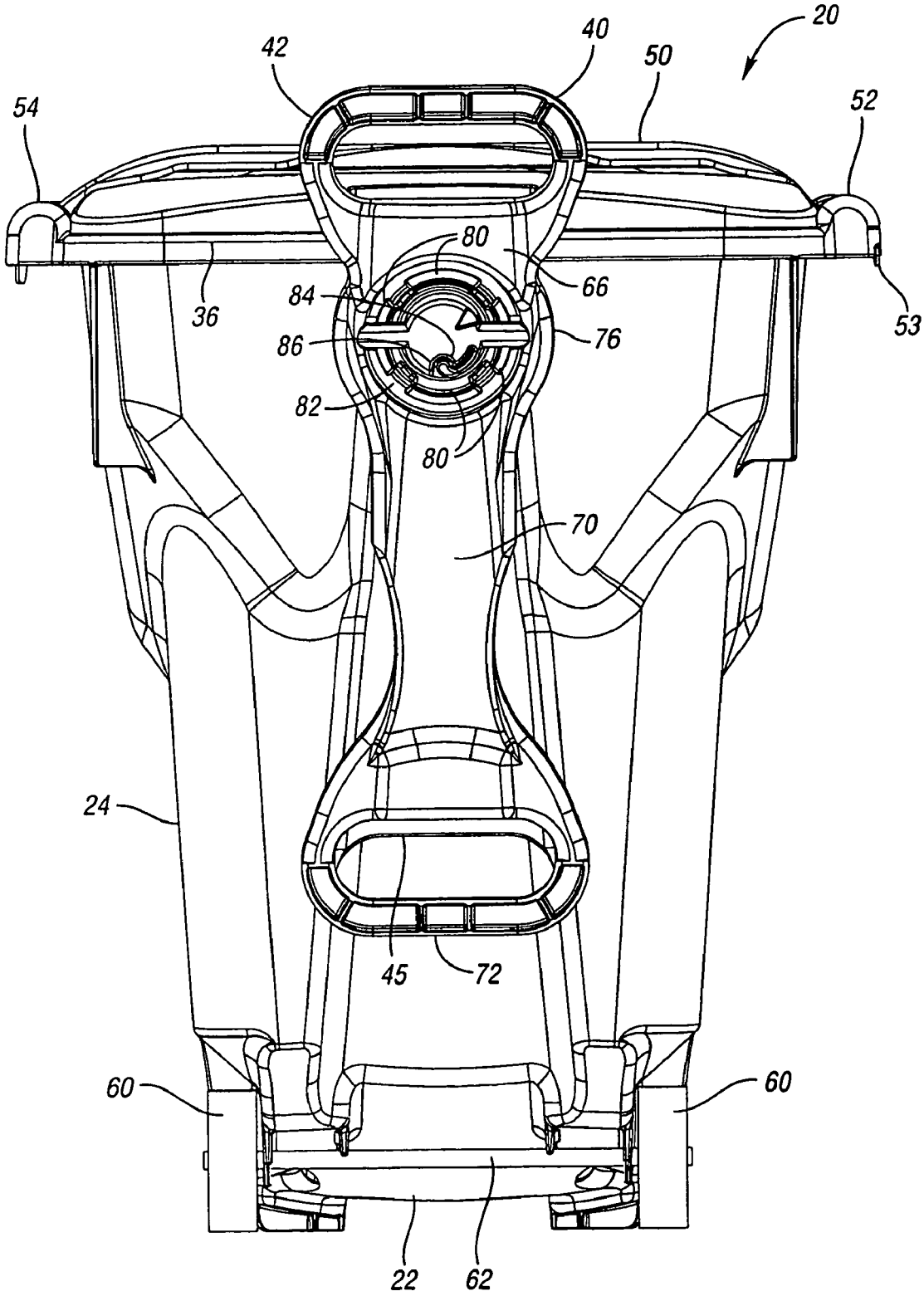
FIG. 3 is a rear view of the waste container of FIG. 1.
Figure 10:
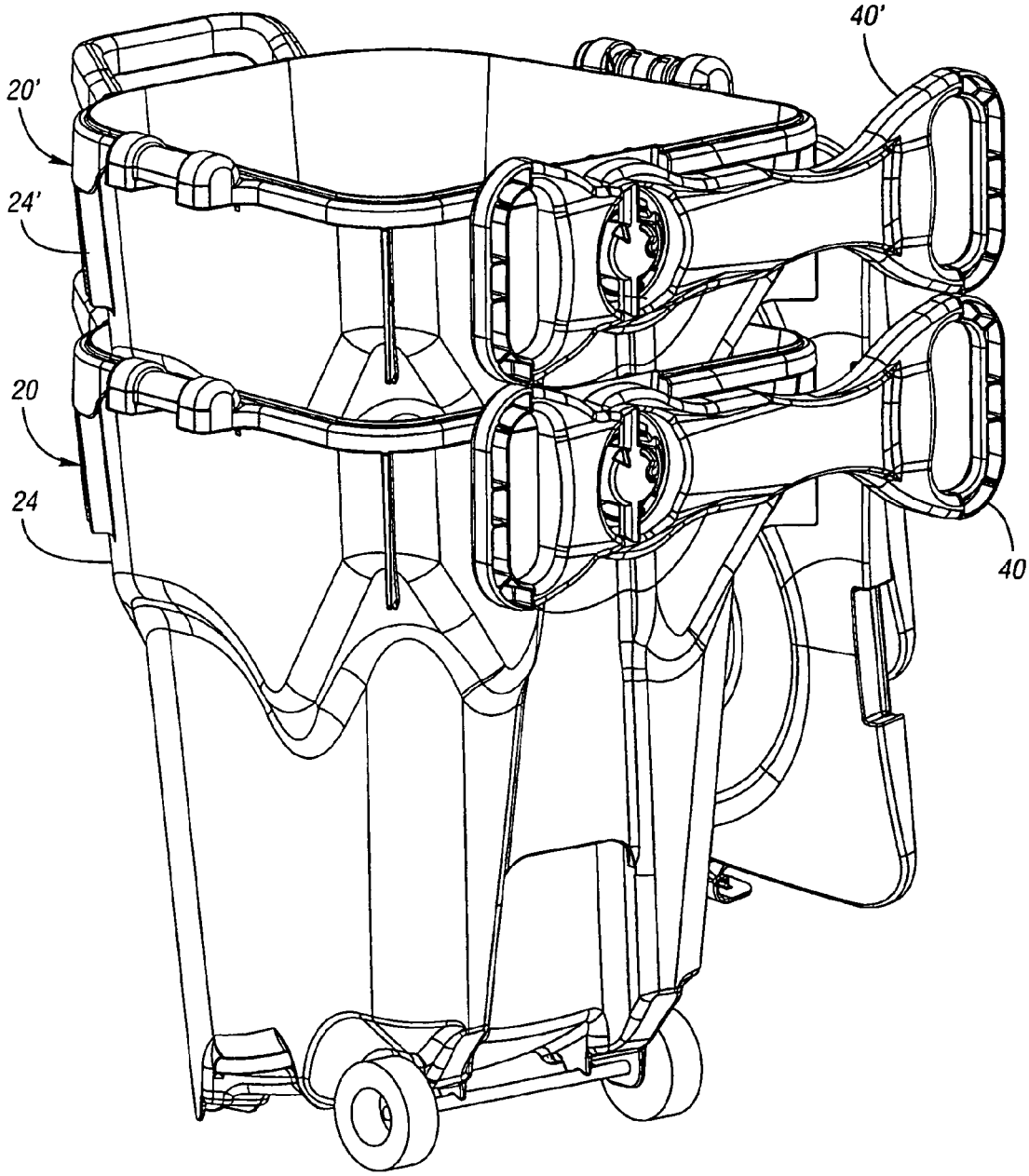
FIG. 10 illustrates a similar waste container nested in the waste container of FIG. 1.

In use, the handle 40 can be rotated to a first position as shown in FIG. 3, in which the first grip 40 at the outer end of the short arm 66 extends upwardly above the upper edge 36 of the sidewall 24. In this position, lifting and emptying the container 20 into the hopper of a truck is facilitated. The base 76 of the handle 40 includes a cantilevered tab 84 biased into a series of three detents 86 on the side wall 24, to lock the handle 40 in one of three positions: the position shown in FIG. 3, the position shown in FIG. 4, and a position 90 degrees in between (FIG. 10). The base 76 of the handle 40 also includes stops that interact with surfaces protruding from side wall 24 to prevent rotation of the handle 40 outside this 180 degree range.

Figure 4:
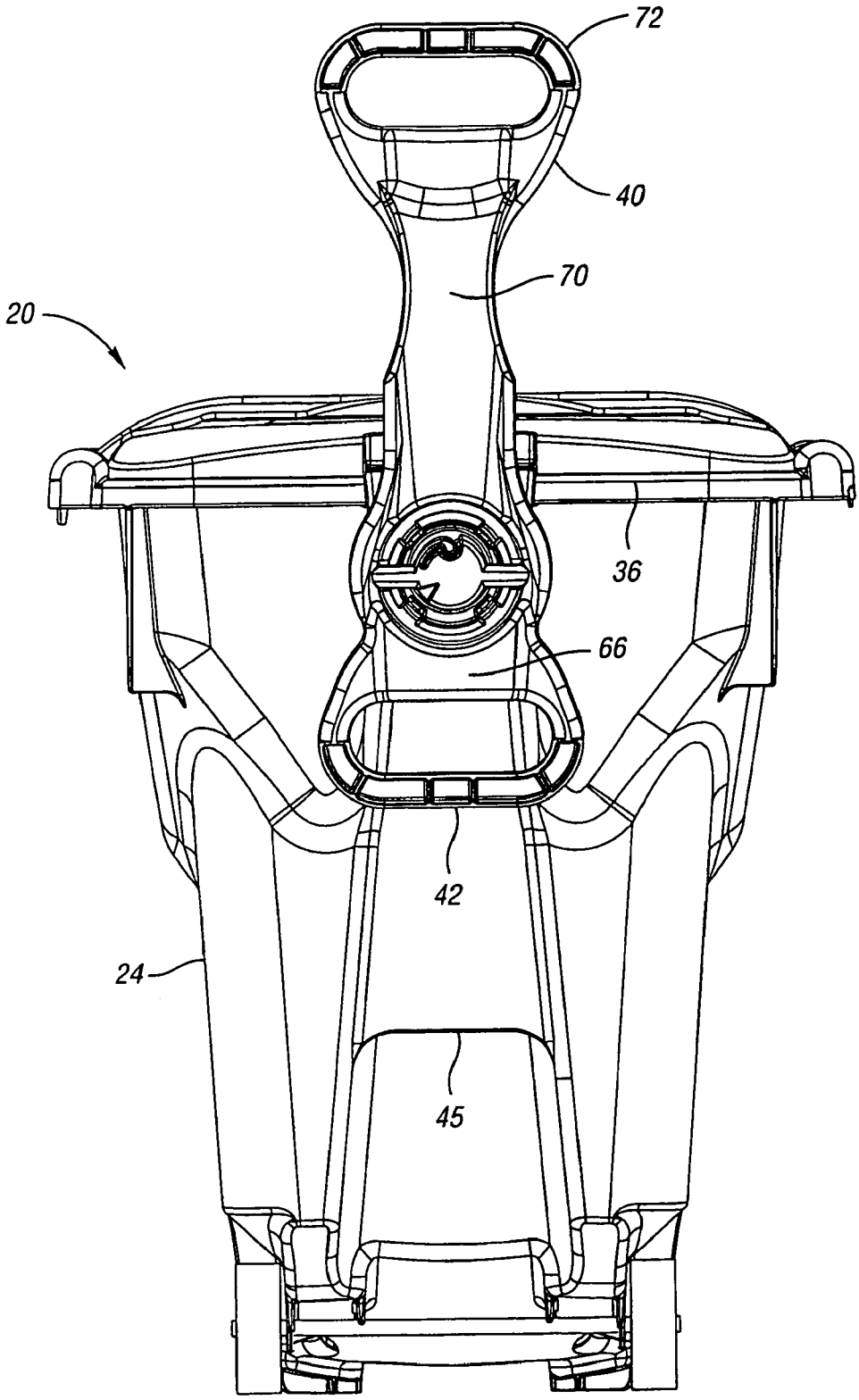
FIG. 4 is the waste container of FIG. 3 with the handle in a second position.

Optionally, as shown in FIG. 4, the handle 40 can be rotated about its axis 68 until the second arm 70 is in a second position, with the grip 72 extending above the upper edge 36 of the side wall 24. It should be noted that the long arm 70 is longer than the short arm 66. Therefore, the grip 72 extends a much greater height above the upper edge 36 when the second arm 70 is in the use position than does the first grip 40 when the shorter arm 66 is in the use position. In the position shown in FIG. 4, the waste container 20 is easier to tip back onto its wheels 60 for pulling by the user.

Figure 5:
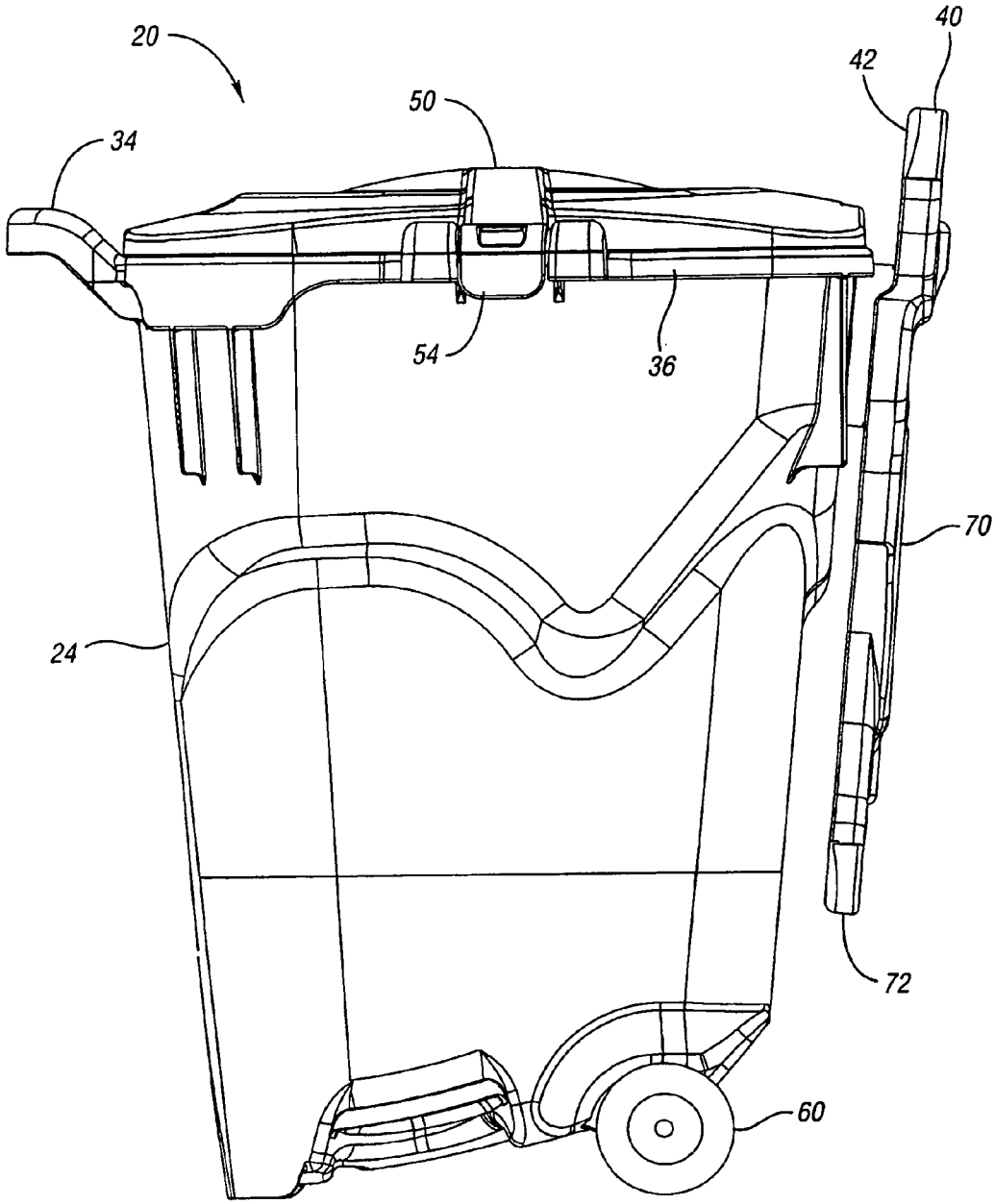
FIG. 5 is a first side view of the waste container of FIG. 1.
Figure 6:
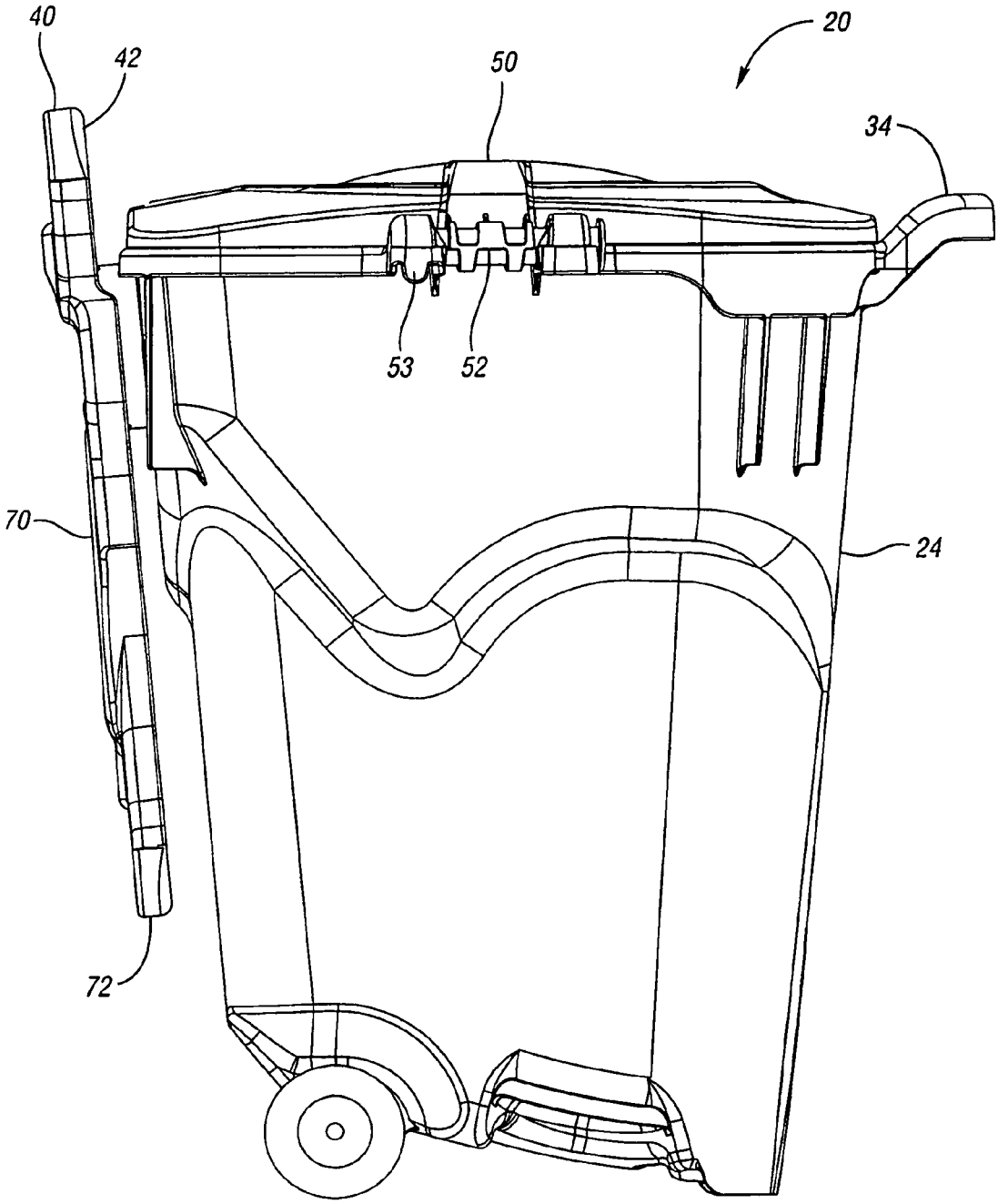
FIG. 6 is a second side view of the waste container of FIG. 1.
Figure 7:
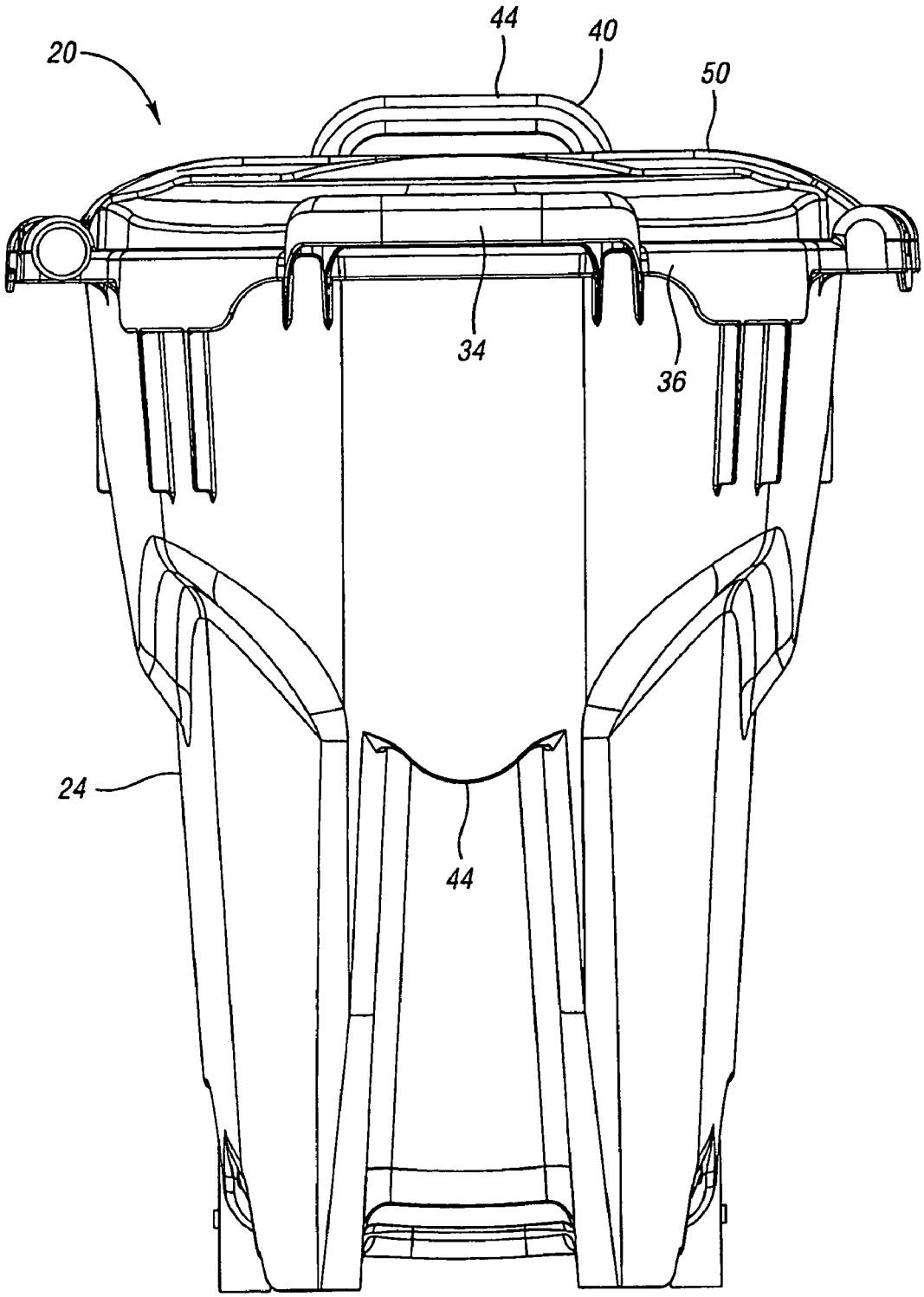
FIG. 7 is a front view of the waste container of FIG. 1.
Figure 8:
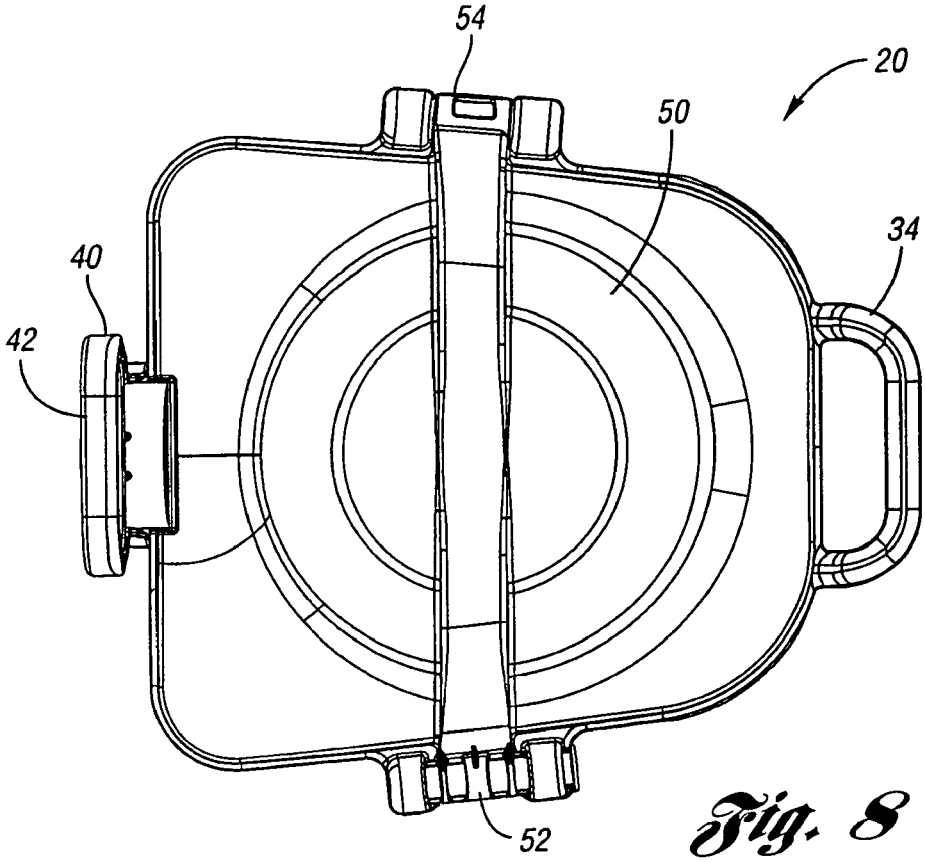
FIG. 8 is a top view of the waste container of FIG. 1.
Figure 9:
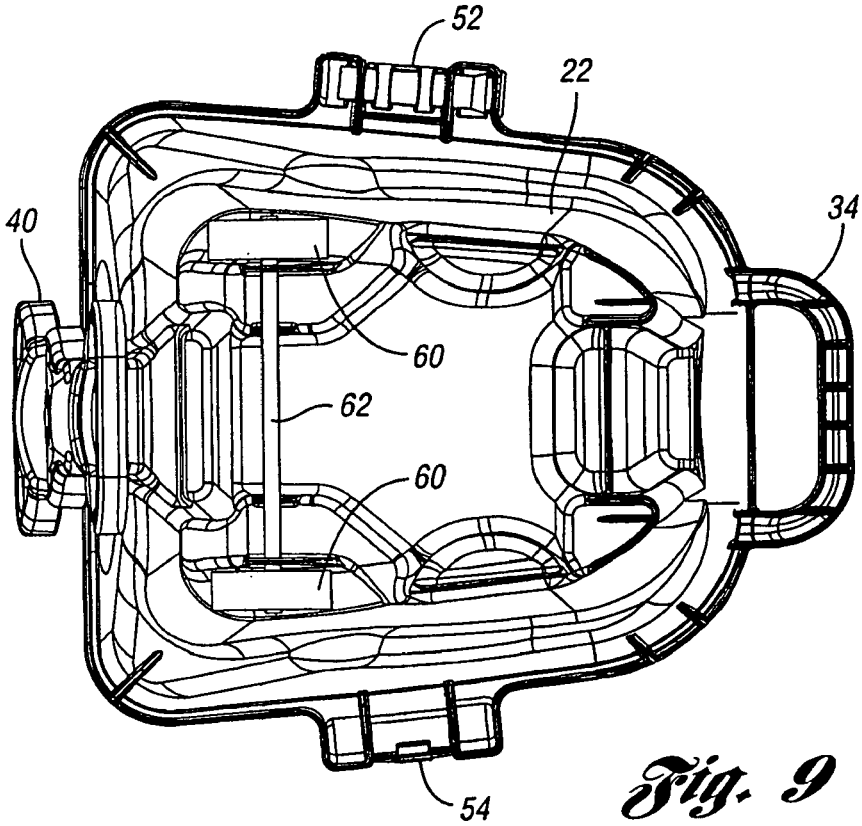
FIG. 9 is a bottom view of the waste container of FIG. 1.

FIGS. 5 and 6 are side views of the waste container 20 according to the present invention, with the handle 40 rotated so that the first arm 66 and grip 42 extend above the upper edge 36. FIG. 7 is a front view of the waste container 20 according to the present invention. FIG. 8 is a top view of the waste container 20 according to the present invention. FIG. 9 is a bottom view of the waste container 20 according to the present invention.

FIG. 10 illustrates a waste container 20' similar to waste container 20. As shown, the waste container 20' can be substantially nested in waste container 20 with the handles 40, 40' rotated to the 90 degree position and with the lids 50, 50' opened, but still attached. Nesting stops 74 are provided in the corner areas of the container 20.

Figure 11:
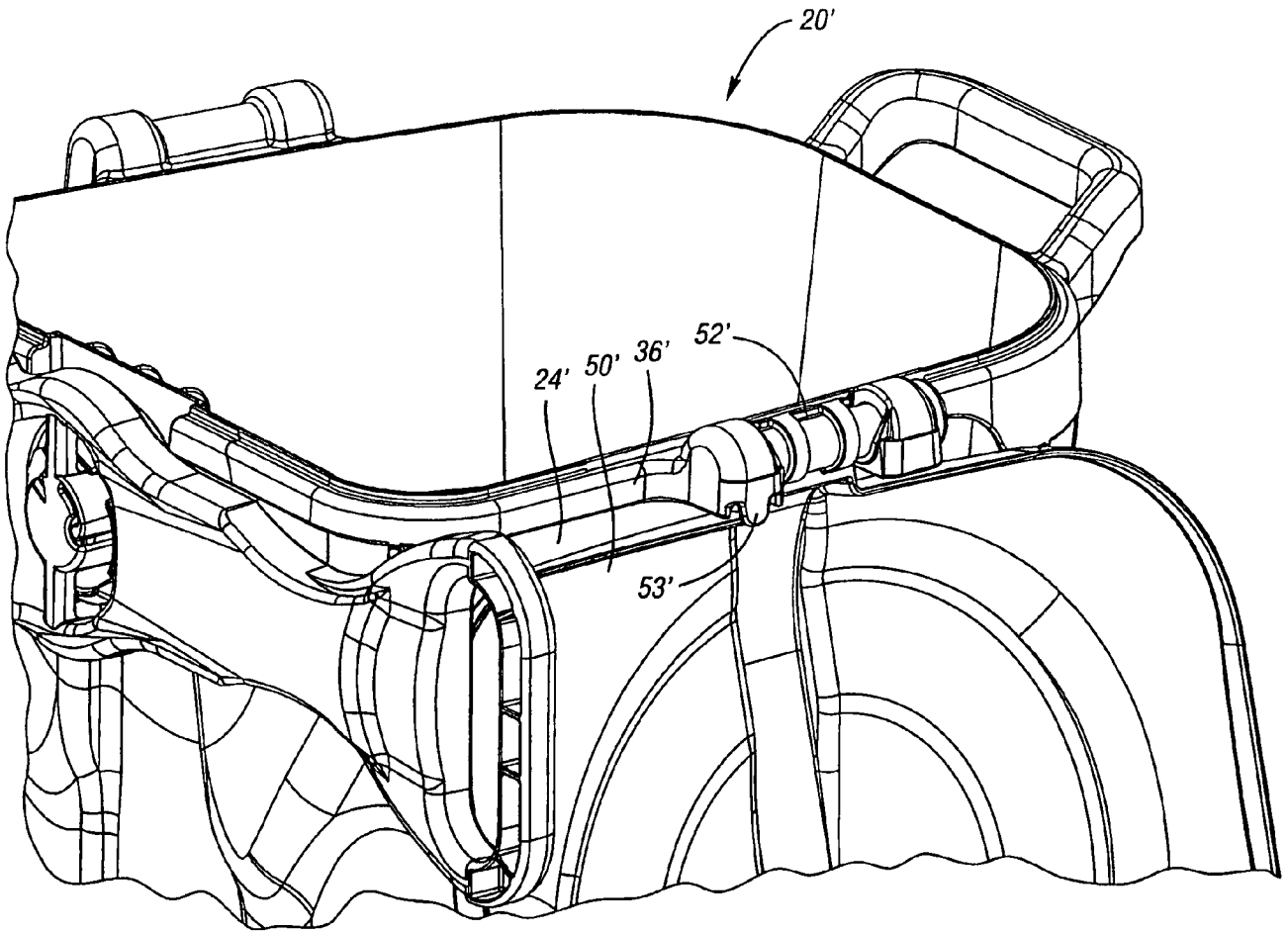
FIG. 11 is an enlarged view of the hinge of the nested waste container of FIG. 10.

FIG. 11 is an enlarged view of the hinge 52' of the waste container 20' of FIG. 10, showing the lid 50' snapped past the catch tab 53' to retain the lid 50' below the upper edge 36' even when the waste container 20' is inverted for dumping the contents.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A waste container comprising:

a bottom wall;

at least one side wall substantially perpendicular to the bottom wall and extending about a periphery of the bottom wall;

at least one wheel generally disposed below a first portion of the side wall and rotatable about a wheel axis, wherein the wheel axis is proximate to an intersection created by the first portion of the side wall and the bottom wall; and an adjustable handle extending upward from the side wall to a grip parallel to the wheel axis, the handle pivotably mounted at the pivot point to the side wall, wherein the handle pivots about a pivot axis, the pivot axis not parallel with the wheel axis.

2. The waste container of claim 1, wherein the grip extends a first distance above an upper end of the side wall when the handle is rotated to a first position, and the grip extends a second distance below the upper end of the side wall when the adjustable handle is rotated to a second position.

3. The waste container of claim 2, wherein the first position and the second position are substantially 180 degrees away from one another about the pivot point.

4. The waste container of claim 1, wherein the at least one wheel is rotatably mounted below the first portion of the side wall and positioned generally below the adjustable handle.

5. The waste container of claim 1, further including a lid pivotable about a hinge axis at an upper edge of the side wall, the adjustable handle pivoting about a first axis parallel to the hinge axis.

6. The waste container of claim 1, further including a lid pivotably connected at an upper edge of the side wall, the lid pivotable about a lid axis not perpendicular to a first axis about which the adjustable handle is pivotable.

7. The waste container of claim 6, wherein the at least one wheel is generally disposed below the side wall and rotatable about the wheel axis not parallel to the lid axis.

8. The waste container of claim 7, wherein the wheel axis is fixed in relation to the lid axis.

9. A waste container comprising:

a bottom wall;

at least one side wall substantially perpendicular to the bottom wall and extending about a periphery of the bottom wall;

an adjustable handle pivotably mounted to a portion of the side wall, extending linearly to a free end, wherein the free end extends a first maximum distance above an upper edge of the side wall when the adjustable handle is pivoted to a first position, and the free end extends a second maximum distance below the upper edge of the side wall when the adjustable arm is pivoted to a second position, wherein the adjustable handle is pivotable in a plane parallel to the potion of side wall to which the adjustable handle is pivotably mounted.

10. The waste container of claim 9, wherein the adjustable handle is pivotably mounted to the side wall at a pivot point.

11. The waste container of claim 9, wherein the adjustable handle is generally parallel to a plane defined by the side wall when the adjustable handle is in the first position.

12. The waste container of claim 11, wherein the adjustable handle is generally parallel to a plane defined by the side wall when adjustable handle is in the second position.

13. The waste container of claim 9, wherein the first position and the second position extend in opposite directions from a pivot point.

14. The waste container of claim 13, wherein the first position and the second position are substantially 180 degrees away from one another about the pivot point.

15. The waste container of claim 14, wherein the pivot point defines a pivot axis, and further including a lid pivotably connected at an upper edge of the side wall, the lid pivotable about a lid axis substantially parallel to the pivot axis.

16. The waste container of claim 9, wherein the adjustable handle is pivotable through at least 180 degrees.

17. A waste container comprising:

a bottom wall;

at least one side wall extending upward from the bottom wall and extending about a periphery of the bottom wall;

a lid pivotable about a lid axis at an upper edge of the side wall; and a handle mounted to a portion of the side wall, extending linearly a first distance upward from a mounting point located below the upper edge of the side wall to a free end having a grip not parallel to the lid axis, and a second distance downward from the mounting point located below the upper edge of the side wall, wherein the handle is pivotable about a pivot axis substantially parallel to the lid axis, and where in the handle is pivotable in a plane parallel to the portion of the side wall to which the handle is pivotably mounted.

18. The waste container of claim 17, wherein the mounting point is a pivot point.

19. The waste container of claim 17, wherein the pivot axis passes through a point located substantially near a midpoint of an interior space of the waste container.

20. A waste container comprising:

a bottom wall;

at least one side wall extending upwardly from a periphery of the bottom wall;

an adjustable handle mounted to a portion of the side wall, extending linearly from a pivot axis to a free end having a grip, the adjustable handle pivotable about the pivot axis between a first position and a second position, the grip located at a first distance relative to an upper edge of the at least one side wall when the adjustable handle is in the first position, the grip located at a second distance relative to the upper edge of the at least one side wall when the adjustable handle is in the second position, the second distance greater than the first distance, wherein the adjustable handle is pivotable in a plane parallel to the portion of the side wall to which the adjustable handle is pivotably mounted.

21. The waste container of claim 20, wherein the pivot axis is not parallel to the grip.

22. The waste container of claim 20, wherein the grip is located above the pivot axis when the adjustable handle is in the first position.

23. The waste container of claim 20, wherein the grip is below the pivot axis when the adjustable handle is in the second position.

24. The waste container of claim 20, wherein the grip defines a first axis when the adjustable handle is in the first position and defines a second axis when the adjustable handle is in the second position, the first axis and the second axis parallel to one another.

25. The waste container of claim 24, wherein the first axis and the second axis are not parallel to the pivot axis.

26. The waste container of claim 20, further including a lid pivotably connected at the upper edge of the at least one side wall, the lid pivotable about a lid axis substantially parallel to the pivot axis.

27. A waste container comprising:

a bottom wall;

at least one side wall extending upwardly from a periphery of the bottom wall;

an adjustable handle mounted to a first portion of the side wall, extending from a pivot axis to a grip, the adjustable handle pivotable about the pivot axis between a first position and a second position, the pivot axis not parallel to the first portion of the side wall, the grip extending a first distance above an upper edge of the at least one side wall when the adjustable arm is in the first position and extending a second distance below the upper edge of the at least one side wall when the adjustable arm is in the second position, the second distance greater than the first distance; and at least one wheel generally disposed below the first portion of the side wall and rotatable about a wheel axis, wherein the wheel axis is not parallel to the pivot axis.

28. The waste container of claim 27, wherein the wheel axis is fixed in relation to the pivot axis.

* * * * *

UNITED STATES PATENT AND TRADEMARK OFFICE

CERTIFICATE OF CORRECTION

PATENT NO. : 7,287,665 B2
APPLICATION NO. : 11/542505
DATED : October 30, 2007
INVENTOR(S) : Meissen et al.

It is certified that error appears in the above-identified patent and that said Letters Patent is hereby corrected as shown below:

In Column 4, Claim 1, Line 23 of the issued patent, "the pivot point" should read as --a pivot point--.

In Column 4, Claim 9, Line 62 of the issued patent, "the adjustable arm" should read as --the adjustable handle--.

Signed and Sealed this

First Day of July, 2008

JON W. DUDAS
*Director of the United States Patent and Trademark Office*